US007275282B2

(12) United States Patent
Brose

(10) Patent No.: US 7,275,282 B2
(45) Date of Patent: Oct. 2, 2007

(54) MOTOR VEHICLE DOOR LOCK

(75) Inventor: Simon Brose, Hattingen (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 11/060,599

(22) Filed: Feb. 18, 2005

(65) Prior Publication Data

US 2005/0194794 A1 Sep. 8, 2005

Related U.S. Application Data

(63) Continuation-in-part of application No. PCT/EP03/09049, filed on Aug. 14, 2003.

(30) Foreign Application Priority Data

Aug. 19, 2002 (DE) ..... 102 38 623

(51) Int. Cl.
*E05C 3/06* (2006.01)

(52) U.S. Cl. ..... 16/201; 310/91; 292/144

(58) Field of Classification Search ..... 292/201, 292/DIG. 16 X, 256, 256.63 X, 256.65 X, 292/256.75, 257; 70/451, 466, DIG. 32; 403/315, 316, 319
See application file for complete search history.

(56) References Cited

U.S. PATENT DOCUMENTS 1,877,781 A * 9/1932 Akerlund ..... 248/72
3,385,129 A * 5/1968 Duncan et al. ..... 74/545
3,912,356 A * 10/1975 Johansson ..... 439/400
3,954,238 A * 5/1976 Nivet ..... 248/68.1
4,728,218 A * 3/1988 Durham ..... 403/319
4,823,752 A * 4/1989 Uuskallio ..... 123/400
4,951,524 A * 8/1990 Niskanen ..... 74/502.4
5,035,454 A 7/1991 Fukumoto et al.
5,161,428 A * 11/1992 Petruccello ..... 74/502.4
5,287,030 A * 2/1994 Nutter ..... 310/89
5,503,441 A 4/1996 Schwaiger
5,531,134 A * 7/1996 Petruccello ..... 74/502.4
5,533,704 A * 7/1996 Fischinger et al. ..... 248/603
5,613,406 A * 3/1997 Rutkowski ..... 74/502.6
5,859,485 A * 1/1999 Uehara et al. ..... 310/90
6,142,537 A * 11/2000 Shimada et al. ..... 285/308

(Continued)

FOREIGN PATENT DOCUMENTS

DE 296 09 204 U1 11/1997

(Continued)

*Primary Examiner*—Gary Estremsky
*Assistant Examiner*—Mark Williams
(74) *Attorney, Agent, or Firm*—David S. Safran

(57) ABSTRACT

A motor vehicle door lock having a casing (1), a drive (2) and a fixing device (5) for the drive (2). The fixing device (5) has a receiving element (6) for the drive (2) and the drive is fixed in the receiving element (6) by the fixing device (5). The receiving element (6) is configured at least partly in a resilient manner and has a resiliently movable part (8), the receiving element (6) can be placed in a position that fixes or releases the drive (2) in the receiving element (6), preferably by elastic deformation. The fixing device (5) has an actuatable locking device (9). By actuating the locking device (9), it engages with the receiving element (6) and brings the receiving element (6) into a position by which retains the drive (2).

23 Claims, 8 Drawing Sheets

U.S. PATENT DOCUMENTS

| | | | | |
|---|---|---|---|---|
| 6,452,299 | B2 * | 9/2002 | Drexlmaier | 310/91 |
| 6,707,203 | B2 * | 3/2004 | Wickham | 310/91 |
| 6,866,303 | B2 * | 3/2005 | Szabo et al. | 285/305 |
| 6,998,746 | B2 * | 2/2006 | Simpson et al. | 310/90 |

FOREIGN PATENT DOCUMENTS

| | | |
|---|---|---|
| DE | 296 12 959 U1 | 1/1998 |
| DE | 297 13 099 U1 | 1/1998 |
| DE | 199 43 497 A1 | 3/2001 |
| GB | 1 520 624 | 8/1978 |
| GB | 2 298 453 A | 9/1996 |

* cited by examiner

MOTOR VEHICLE DOOR LOCK

CROSS REFERENCE TO RELATED APPLICATION

This application is a continuation-in-part of International Patent Application PCT/EP2003/009049 which designates the United States of America.

BACKGROUND OF THE INVENTION

1. Field of Invention

This invention relates to a motor vehicle door lock having a housing with a receiver for a drive and to a process for installing a drive in the motor vehicle door lock Here, the expression motor vehicle door lock includes all types of door, hood or hatch locks.

2. Description of Related Art

The motor vehicle door lock under consideration has a drive which can be a central locking drive, an auxiliary opening drive, a drive for switching between different lock states, or the like. Here, the drive can simply be a drive motor with a drive shaft or a combination of a drive motor, transmission elements and gearing.

Generally, it is such that the drive, in its installed state, is fixed by a mounting device in a corresponding receiver. Fixing can be performed clipping the drive into a plastic housing part, as is disclosed, for example, in German Utility Model DE 296 09 204 U1. German Utility Model DE 296 09 204 U1 shows a mounting device with a receiver which encloses the drive, here the drive motor with a drive shaft, on its ends. The receiver is made such that the drive can be inserted into the receiver for installation. To fix the drive, therefore to prevent the drive from sliding out, there is a cover which is used as a hold-down. The function of this hold-down can also be assumed, for example, by another housing part or the like.

The aforementioned approach is advantageous due to the especially simple implementation and by the possibility of being able to transmit especially high torques by the drive without the location of the drive in the receiver changing.

In any case, in the aforementioned concept, the problem is that a hold-down, specifically a housing cover or the like, cannot be omitted. This results in a drastic structural limitation for the installation space above the drive which must be fundamentally kept free at least in part for the aforementioned hold-down. This structural limitation is not compatible with the requirement for high compactness, and as a result, for high integration density.

SUMMARY OF THE INVENTION

A primary object of the invention is to embody and develop the above explained known motor vehicle door lock such that, at an invariably high load capacity of the mounting device, there are no structural limitations for the installation space above the drive.

The aforementioned object is achieved for a motor vehicle door lock in accordance with invention by the receiver being made at least partially flexible, having a part that can be shifted into the fixing or releasing state, preferably, by elastic deformation. All of the holding force which may be required to fix the drive is now applied by the receiver so that a hold-down, cover or the like can be eliminated.

There are, of course, a host of possibilities for embodying and developing the teaching of the invention. In one preferred configuration, the undeformed receiver is already in its fixed state. Then, it is sufficient if, with actuation of the locking mechanism, the locking mechanism positively engages the flexible part of the receiver. If, in this case, a force or a torque from the drive acts on the receiver, the locking mechanism keeps the receiver in the fixing state. The locking mechanism, to a certain extent, represents a reinforcement of the flexible part of the receiver. This, among others, has the advantage in installation that, even when the locking mechanism is not actuated, a certain holding force is acting on the drive.

However, it can also be provided that, with the actuation of the locking mechanism, the locking mechanism engages the flexible part of the receiver in a non-positive manner, in this way deforms the receiver, and finally moves it into the fixing state. This can be advantageous especially when, in the installed state, the action of a force from the receiver on the drive is continuously required.

In one preferred configuration of the receiver, it has a bridge-shaped configuration which enables simple, material-saving and moreover flexible implementation.

The locking mechanism can be a slide with the actuation of the locking mechanism being provided by the displacement—actuation—of the slide in the actuation direction. The configuration should be especially emphasized such that the drive can be inserted into the receiver by an installation motion in an installation direction and that the actuating direction of the locking mechanism, especially of the slide, essentially corresponds to the installation direction of the installation motion. This leads to especially simple installation especially with respect to its capacity to be automated.

A pivoting locking mechanism can likewise lead to especially simple installation of the drive.

For further reducing the effort during installation, the locking mechanism, especially the slide, is fixed before installation in the unactuated state via a predetermined breaking point, preferably a film hinge or the like. When the slide is actuated, the predetermined breaking point breaks and enables further actuation of the slide. Thus, the slide, even before installation, to a certain extent, is a component of the motor vehicle door lock and need not be supplied separately for installation.

According to one further preferred embodiment, specifically that the mounting device is made in several parts with a receiver and a locking mechanism on the two end of the drive. This leads to an especially favorable distribution of the holding force between the two receivers.

As has already been explained above, the installation space above the drive with the described mounting device is fundamentally not subject to any construction limitations. This applies especially when the mounting device viewed in the corresponding direction is made flatter than the drive. Because the holding forces are accommodated completely by the receiver, a hold-down cover or the like for the drive is therefore not necessary; this can be implemented under almost all conceivable boundary conditions.

According to an especially economical version which is simple to produce, the mounting device is at least in part an integral component of the housing. Especially for housings which have been produced in an injection molding process this is particularly advantageous.

Finally, another teaching which acquires independent importance is a process for installation of a drive in a motor vehicle door lock. Here, it is important that in a single installation motion with a single installation direction both the drive is inserted into the receiver and then the locking mechanism is actuated. This process is especially suited for robotized installation.

The invention is explained in detail with reference to the accompanying drawings.

DETAILED DESCRIPTION OF THE INVENTION

Figure 1:
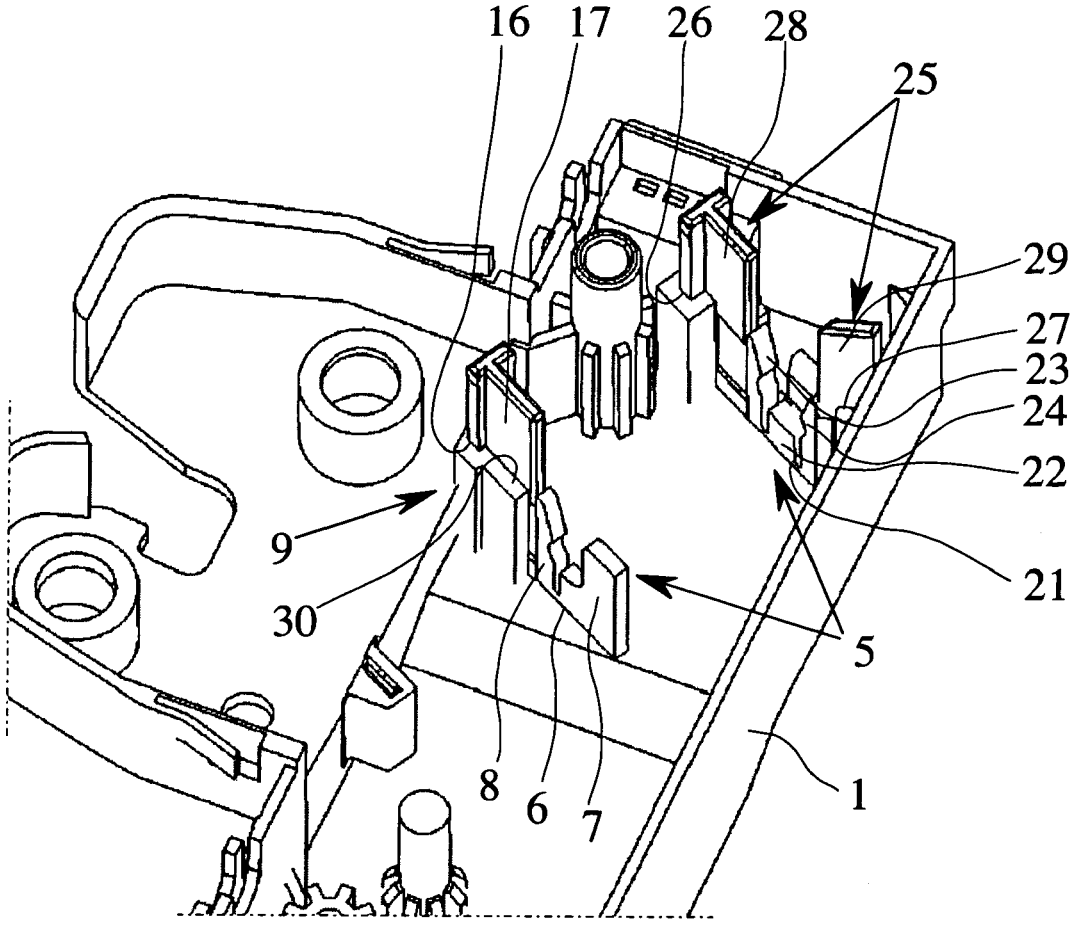
FIG. 1 is a perspective view which shows the housing of a motor vehicle door lock before installation.
Figure 2:
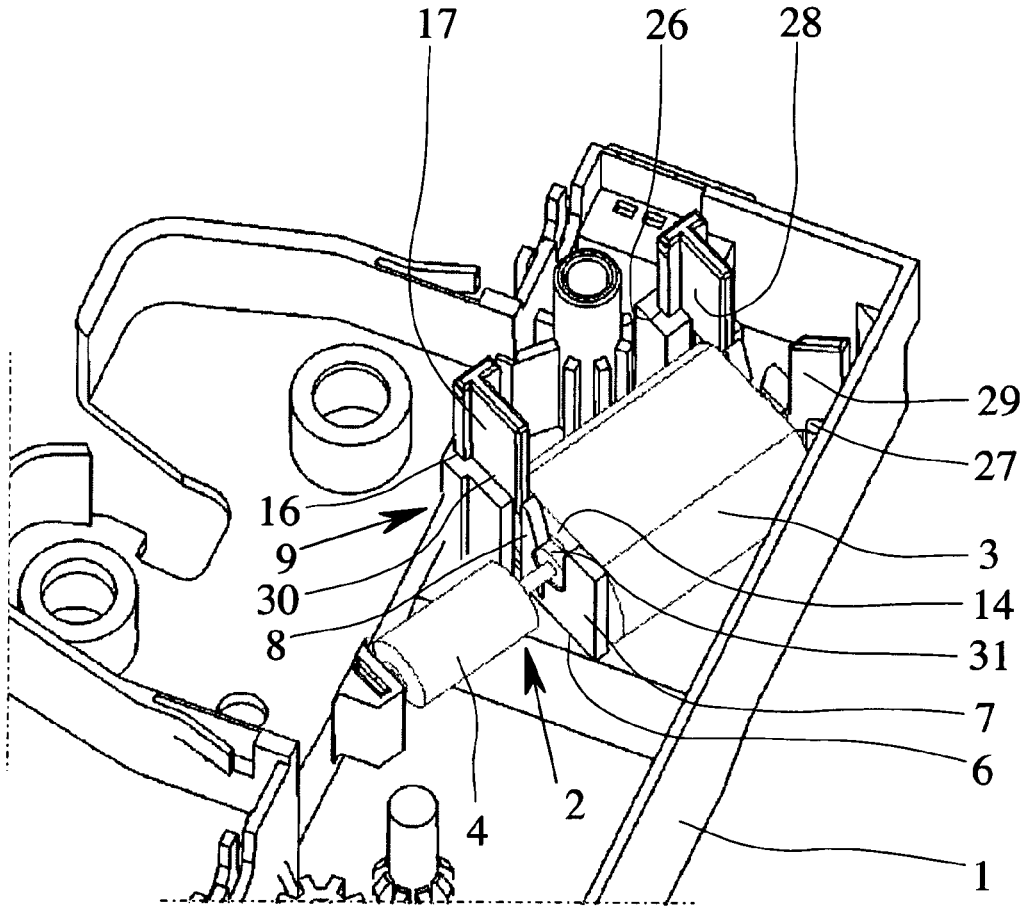
FIG. 2 is a perspective view of the housing of FIG. 1 with an inserted drive and an unactuated locking mechanism.

The housing 1 which is shown in FIG. 1 is designed for a motor vehicle door lock which has a drive 2. The function of the drive 2 is not important here, it can be, for example, a central locking drive, an auxiliary opening drive, a drive for switching between different lock states, or the like. The drive 2 has a drive motor 3 and a transmission element 4. The drive motor 3 and the transmission element 4 are shown in FIG. 2.

Figure 4:
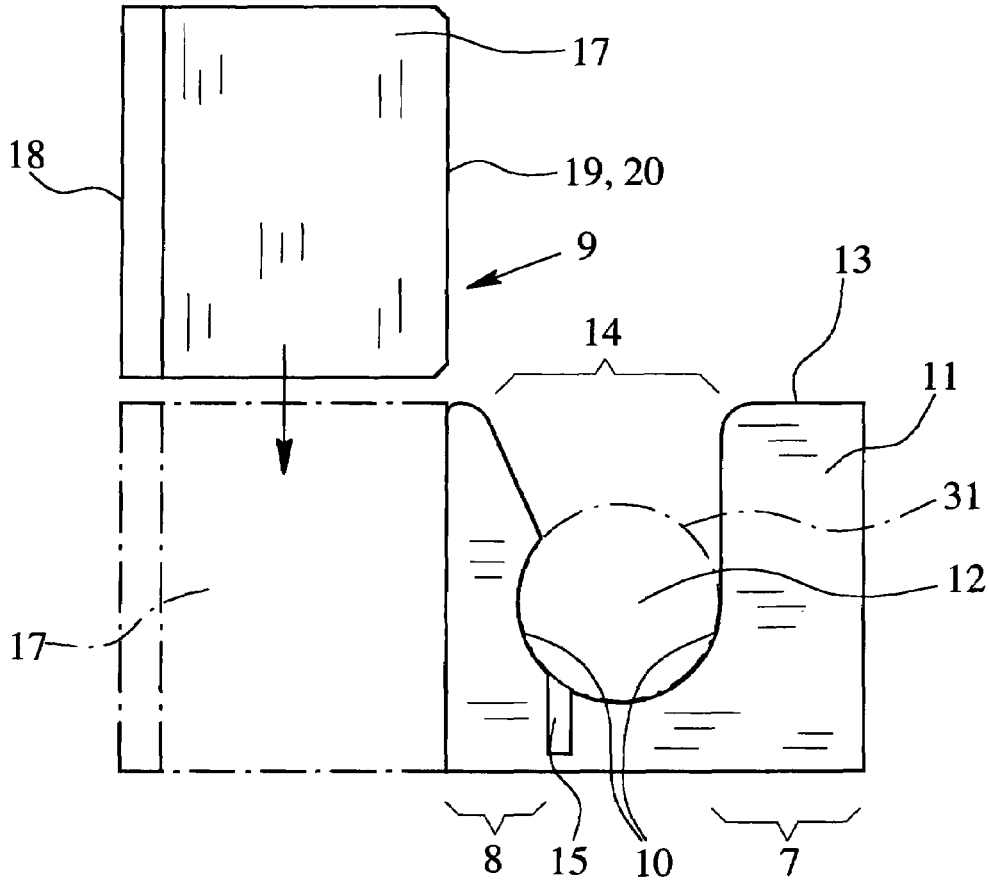
FIG. 4 is a side view of a receiver with a locking mechanism of the motor vehicle door lock from FIG. 1.

Furthermore, in the embodiment shown in FIG. 1, there is a mounting device 5 which has a receiver 6 for the drive 2. A side view of the receiver 6 is shown in FIG. 4. As is also noted below, the mounting device 5 fixes the drive 2 in the installed state in the receiver 6.

For clarification purposes, it should be pointed out that the mounting device 5, in this embodiment, has two receivers, of which the receiver 6 shown in the foreground in FIG. 1 will be used for explanation purposes.

The receiver 6 is made partially flexible here. The flexibility is a result of the shaping of the receiver 6 and the choice of its material. The receiver 6 has a rigid part 7 and a flexible part 8 which can be deformed or moved, preferably elastically, by the action of a force. FIGS. 2 & 4 show that the receiver 6 with the drive 2 inserted is hardly deformed or is not deformed at all and that the drive 2 can be released by elastic deformation of the flexible part 8 in FIG. 4 to the left and can be removed from the receiver 6.

Figure 3:
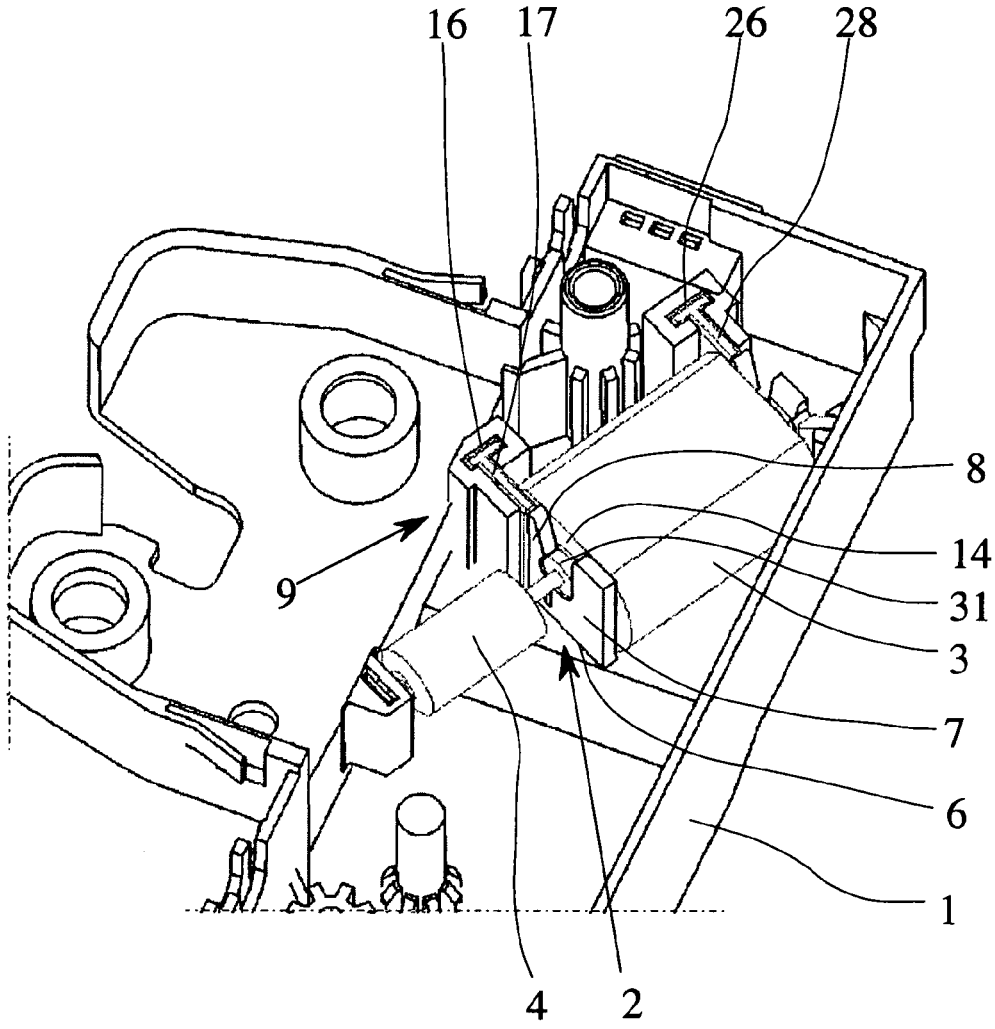
FIG. 3 is a perspective view of the housing from FIG. 1 with an inserted drive and actuated locking mechanism.

The mounting device 5 has an actuatable locking mechanism 9 which is shown in FIGS. 1 & 2 in the unactuated state and in FIG. 3 in the actuated state. In FIG. 4, the actuated locking mechanism 9 is shown by the dot-dash line. With actuation of the locking mechanism 9, the locking mechanism 9 engages the receiver 6, especially the flexible part 8 of the receiver 6, and keeps the receiver 6 in the fixing state. In the illustrated embodiment, it is therefore such that the locking mechanism 9 keeps the receiver 6 in its essentially undeformed state which corresponds here to the fixing state.

However, it need not be such that the undeformed receiver 6 fixes the drive 2 in the receiver 6 the deformed receiver releases it. Instead, the undeformed receiver 6 can release the drive 2, therefore to allow insertion and removal of the drive 2 without hindrance. Then, it is preferably provided that, with the actuation of the locking mechanism 9, the locking mechanism 9 engages the flexible part 8 of the receiver 6 in a positive or non-positive manner and shifts the receiver 6 into the fixing state. As already explained, it is thus possible to ensure the continuous action of the force of the receiver 6 on the drive 2. In particular, this is especially advantageous in order to prevent play between the receiver 6 and the drive 2.

It should be pointed out that the unactuated locking mechanism 9 here can also interact with the receiver 6 as long as the above described action of actuation of the locking mechanism 9 is ensured. This is shown in FIGS. 1 & 2. In FIG. 4, on the other hand, a version is shown in which there is no interaction between the locking mechanism 9 and the receiver 6 when the locking mechanism 9 is not actuated.

In the illustrated embodiment, the receiver 6 has a receiver surface 10 which is located, on the one hand, on the rigid part 7 of the receiver 6, and on the other hand, on the flexible part 8 of the receiver 6. FIGS. 2 & 4 show that the receiver 6 with the drive 2 installed via the receiver surface 10 essentially positively engages the drive 2 and that the holding force which may be necessary to fix the drive 2 acts on the drive 2 via the receiver surface 10.

The receiver surface 10 here is made essentially cylindrical. Depending on the configuration of the drive 2, the receiver surface 10 can be adapted accordingly in order to obtain positive locking which is as optimum as possible. In certain applications, it can also be advantageous to abandon the positive locking between the receiver 6 and the drive 2 and to provide a non-positive connection.

In this embodiment, the receiver 6 is made bridge-shaped, i.e., formed of a pair of uprights that are connected by a crosspiece. The receiver surface 10 is formed by a recess 12 which is located in the wall surface 11 of the bridge-shaped receiver 6. In the drawings, the advantage of the bridge-shaped configuration of the receiver 6 is shown especially clearly, specifically that with minimum material cost optimum mechanical properties can be attained, furthermore high flexibility in the configuration being ensured. Instead of the aforementioned bridge-shaped configuration of the receiver 6, other configurations are also possible. Here, reference should be made to the approaches known in the prior art.

The recess 12 here is open toward one edge 13 of the bridge-shaped receiver 6 and thus forms an inlet slot 14 for the drive 2. For this reason, the recess 12 is made preferably at least partially funnel-shaped so that the drive 2 can be easily inserted via the inlet slot 14 into the receiver 6 and optionally elastic deformation of the flexible part 8 of the receiver 6 takes place automatically when the drive 2 is inserted. Here, the inlet slot 14 allows installation, in the drawings from top to bottom, here depending on the configuration of the motor vehicle door lock there can also be other directions.

The bridge-shaped configuration of the receiver 6 has a further advantage. By intentional weakening of the material, here by a slit 15, it is easily possible to vary the flexibility of the flexible part 8 of the receiver 6, especially to increase it.

One especially preferred configuration calls for the flexible part 8 of the receiver 6 to be made otherwise separately from the receiver 6. For example, an inserted sheet metal clip with which especially a high holding force can be achieved would be possible here.

The configuration of the locking mechanism 9 provided in the illustrated embodiment, with a slide 17 which can be moved in the guide 16, leads to especially simple installation. Here, the actuation of the locking mechanism 9 takes place by the displacement, therefore the actuation, of the slide 17 in one direction of actuation. The actuation direction shown in the drawings is from top to bottom. The advantage of this actuation of the locking mechanism 9 is that only one linear motion is required for actuation and thus automated installation of the drive 2 is further simplified.

In this embodiment, the slide 17 viewed in its actuation direction is made oblong. This can lead to especially favorable actuation forces with a corresponding configuration of the slide 17 and receiver 6, for example, if deformation of the receiver 6 is to take place by the actuation of the slide 17.

A series of possibilities for the guide 16 of the slide 17 is known from the prior art. The configuration is especially compact, on the one hand, and reliable, on the other, in which the slide 17 on the lengthwise side 18 is made T-shaped in cross section and can be moved in a guide 16 which corresponds to the T-shaped cross section.

Figure 5:
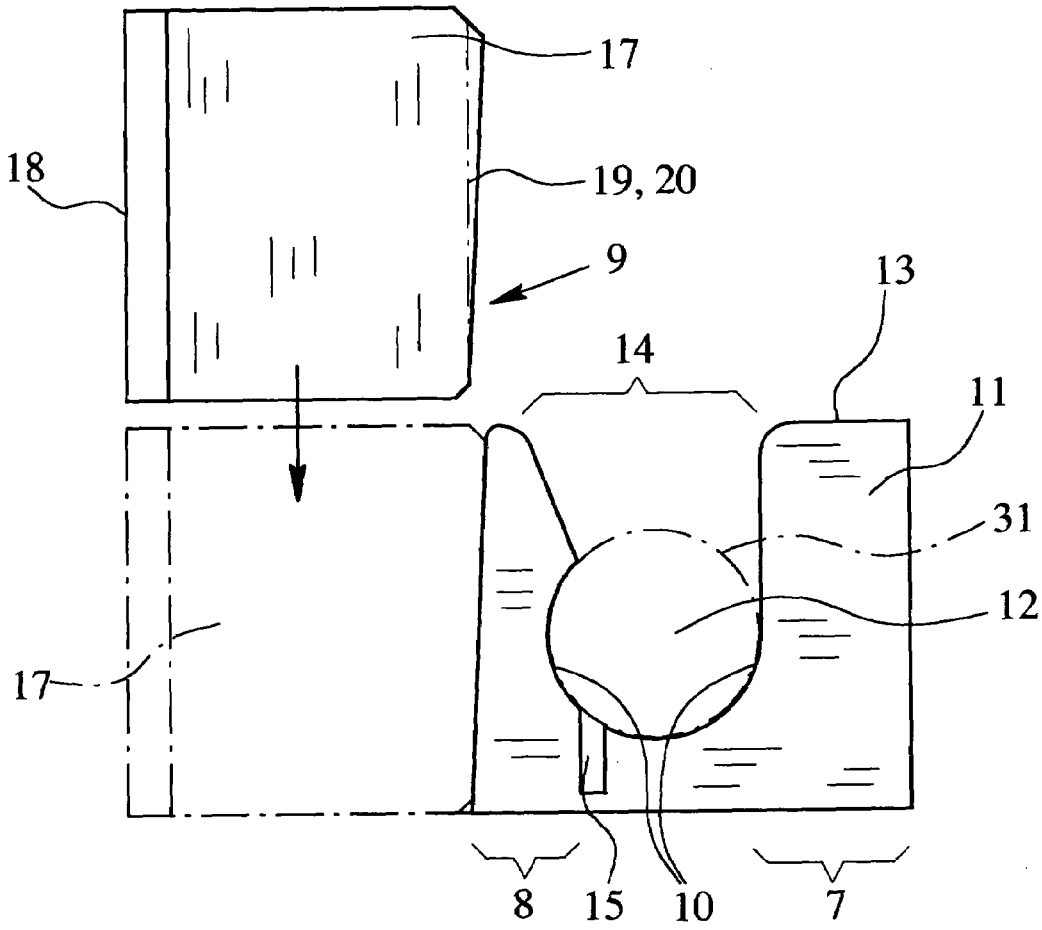
FIG. 5 shows a receiver with a locking mechanism according to a second embodiment.

Preferably, on its other lengthwise side 19, the slide 17 has an actuating surface 20 which engages the receiver 6 when the slide 17 is actuated and keeps it in the fixing state. It can also be provided that, by actuating the slide 17, the receiver 6 is moved into the fixing state, as was already explained above. Then, it is especially advantageous if the slide 17 viewed in the actuating direction is made wedge-shaped, and when it is actuated, deforms the receiver 6 accordingly. This is shown in FIG. 5.

At this point, it should be pointed out that, for the configuration of the slide 17, numerous possibilities are known from the prior art. Reference should be made thereto. For example, in cross section, essentially round or roundish slides 17 are possible also.

At latest, the question arises here how the slide 17 is fixed in its actuated position. This can be accomplished, for example, in that the slide 17 when actuated is joined non-positively to the receiver 6 and is held simply by friction in the actuated position.

In a preferred configuration, it is furthermore provided that the slide 17 on the lengthwise side 19 has a shape and the receiver 6 a corresponding counter-shape, and that with actuation of the slide 17, the shape and the counter-shape engage one another positively and/or non-positively. In particular, it is provided here that when the slide 17 is actuated, elastic deformation of the receiver 6 takes place so that the slide 17 can finally "snap" into the indicated positive locking.

Figure 6:
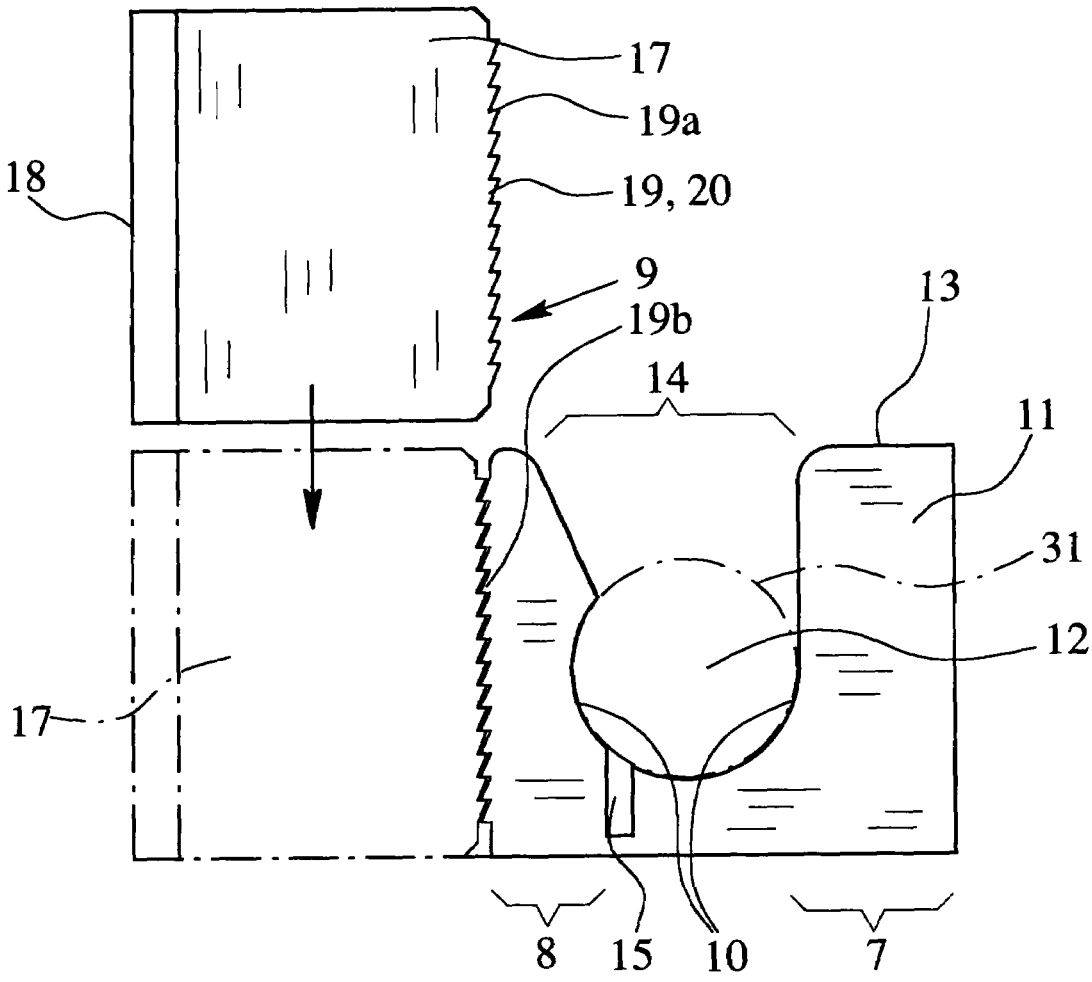
FIG. 6 shows a third embodiment of a receiver with a locking mechanism.

Another possibility for fixing the slide 17 in its actuated position, which is shown in FIG. 6, is that the slide 17, on a lengthwise side 18, 19, has engagement elements 19*a* which, by actuating the slide 17, mesh with counter-engagement elements 19*b* on the receiver 6 or on the guide 16 of the slide 17 and keep the slide 17 accordingly in the actuated position. These engagement elements 19*a*, 19*b* can be made, for example, as individual hook shapes, as pinions which run over the lengthwise side 18, 19 of the slide 17, or simply as an especially rough surface.

Figure 7:
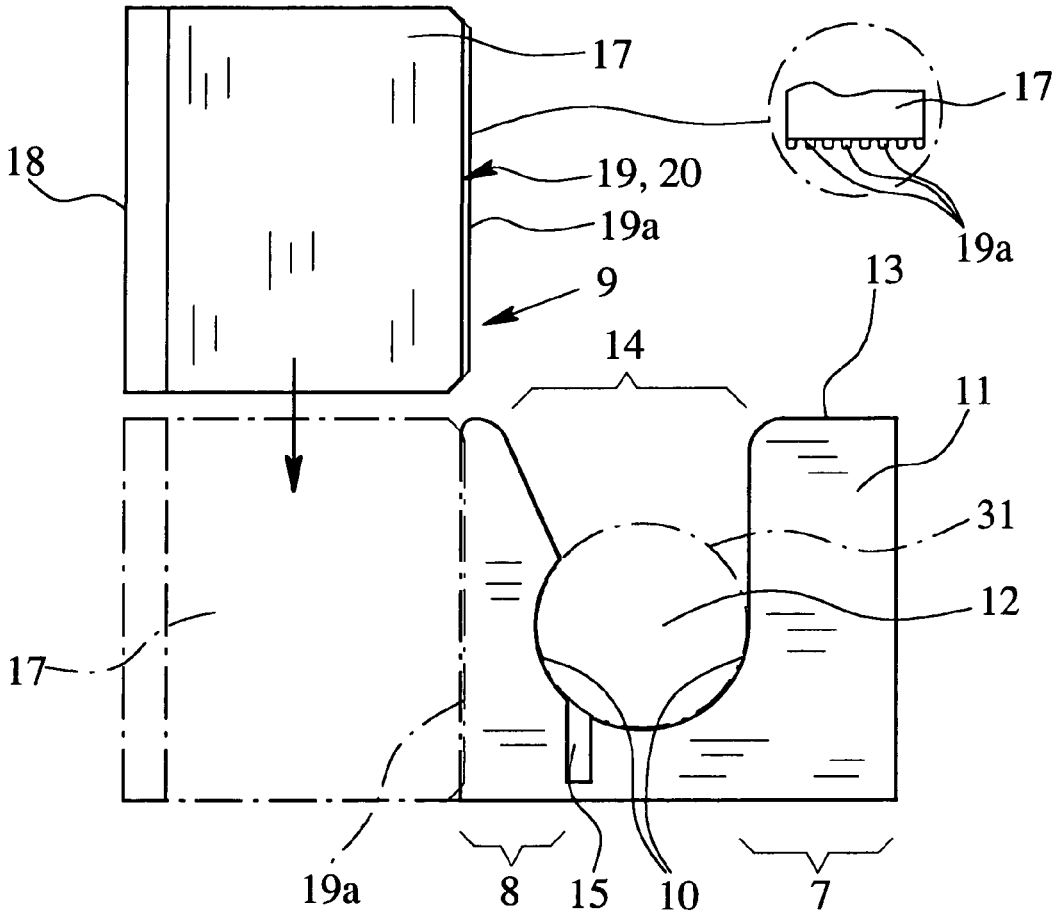
FIG. 7 shows a fourth embodiment of a receiver with a locking mechanism.

Finally, it is provided that a lengthwise side 18, 19 of the slide 17 is outfitted with squeezing ribs 19*a* (shown in the encircled detail of FIG. 7). When the slide 17 is actuated, the squeezing ribs 19*a* engage the receiver 6 or the guide 16 of the slide 17 and are deformed in doing so, such that the slide 17 is fixed in its actuated position by clamping. The configuration of the slide 17 with squeezing ribs is an especially simple and at the same time reliable version of mounting.

It can also be advantageous for the locking mechanism 9 to have not only a single slide, but two slides. This is the case in the receiver 21 which is shown in FIG. 1 in the background. The receiver 21 also has a rigid part 22 here, in contrast to the receiver 6 however, two flexible parts 23, 24. The locking mechanism 25 accordingly has two slides 1, 29 which each can be moved in the guide 26, 27 and which at the corresponding points of the receiver 21 can be caused to engage the receiver 21. One advantage of the configuration of the locking mechanism 9 with two slides 1, 29 is that the symmetrical arrangement with the resulting symmetrical loading of the receiver 21 by the holding force which may be necessary to fix the drive 2. Depending on the boundary condition, it can also be advantageous to assign additional slides to the locking mechanism 9, 25.

Figure 8:
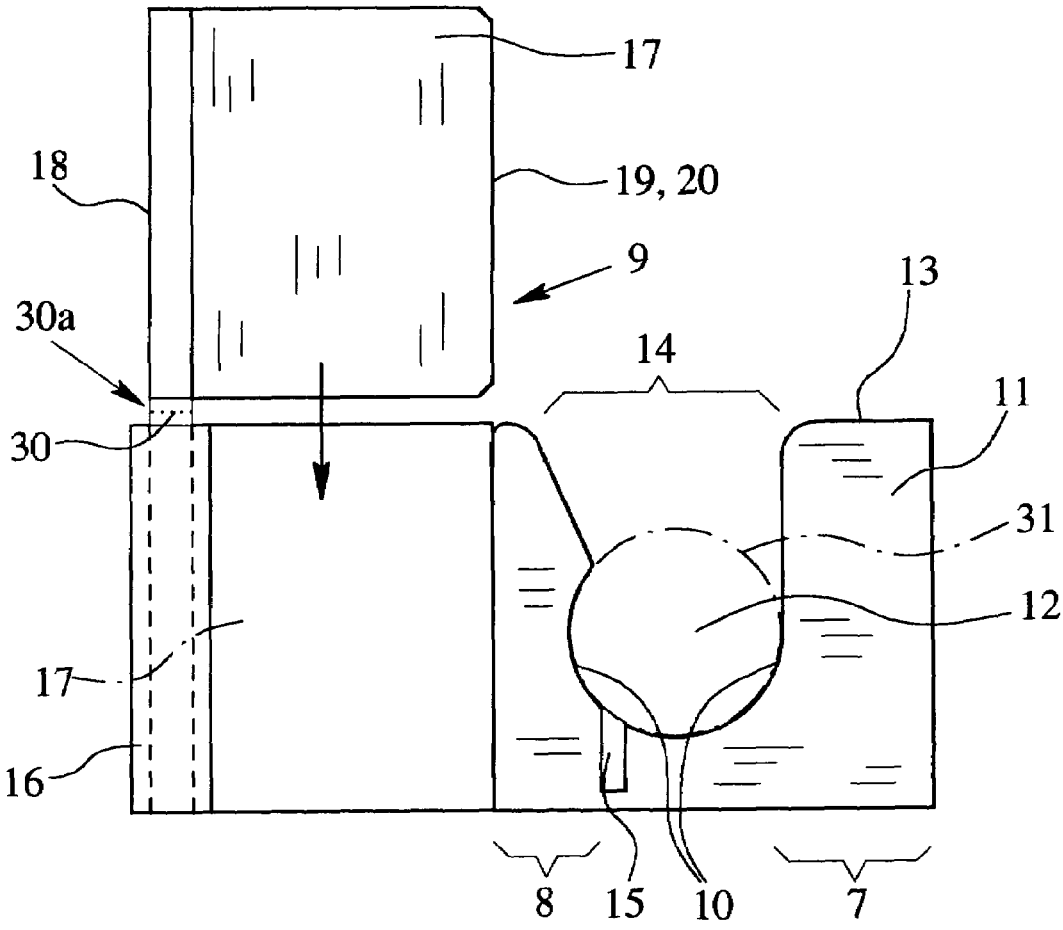
FIG. 8 shows a receiver with a locking mechanism according to a fifth embodiment.

For the configuration of the locking mechanism 9, in addition to the aforementioned slide 17, other advantageous alternatives are possible. One especially preferred configuration calls for the locking mechanism 9 to have a pivot flap and for the actuation of the locking mechanism 9 to be provided by pivoting—actuation—of the flap in the actuating direction. The flap is preferably a plastic angle which is pivotally suspended on a film hinge 30*a*, FIG. 8, or the like.

The installation of the drive especially with respect to the capacity to be automated is especially easy due to the configuration of the locking mechanism 9 with the described flap. Automated actuation of the locking mechanism 9 here can take place, for example, by a roller which rolls over the flap and pivots it accordingly.

The flap preferably has an actuating surface, when the flap is actuated, the actuating surface engaging the receiver 6 and moving it into the fixing state or keeping it there. The measures which have already been described for the slide 17 can be used to fix the flap in the actuated position.

The drawings show that the drive 2 can be inserted into the receiver 6 by an installation movement in an installation direction and that the actuating direction of the locking mechanism 9, especially of the slide 17, corresponds essentially to the installation direction of the installation movement. The aforementioned agreement of the installation direction and actuating direction is advantageous especially in automated installation in which, at this point, a single installation motion in a single direction is sufficient to insert the drive 2 into the receiver 6 and likewise to then actuate the locking mechanism 9. This applies equally to the receiver 21 with the described locking mechanism 25.

Further simplification during installation arises when the locking mechanism 9, especially the slide 17, before installation, is fixed via a predetermined breaking point 30, that by actuating the locking mechanism 9 during installation, the predetermined breaking point 30 breaks and thus further actuation of the locking mechanism 9 is possible. The predetermined breaking point 30 here is implemented by a film hinge which is injection molded onto the guide 16. This "temporary" fixing of the slide 17 leads to further simplification in installation since separate feed of the slide 17 is not necessary.

It has already been pointed out that, in this embodiment, the mounting device 5 has receivers 6, 21 with the corresponding locking mechanisms 9, 25. As shown in FIG. 2, it is preferably that one receiver 6 acts on the front and the second receiver 21 acts on the rear flange 4 which is located on the drive 2. However, it can also be that there are more than two receivers, for example, for lateral support of the drive 2. This can be advantageous when an especially high holding force is necessary.

Furthermore, FIG. 3 shows that the mounting device 5 with the drive 2 mounted and the locking mechanism 9 actuated, viewed in the installation direction, is made flatter than the drive 2 itself. This is possible by simply the receivers' 6, 21 applying a holding force to the drive 2 and acting laterally on the drive 2. A hold-down with a point of application of force on the top of the drive 2 is no longer necessary here. As a result, the installation space on the top of the drive 2 is free so that there are no construction limitations here.

FIGS. 1 to 3 show the housing 1 of the motor vehicle door lock, the mounting device 5 being at least partially an integral component of the housing 1. The slides 17, 1, 29 cannot be regarded here as an integral component of the housing 1, since they are only "temporarily" connected to the housing 1. Preferably, the housing 1 is produced in an injection molding process so that implementation of the mounting device 5 is possible with minimum effort. Installation steps for "installation" of the mounting device 5 in or on the housing 1 are not necessary.

Another independent teaching relates to the housing 1 which is shown in FIGS. 1 to 3 and which has the described mounting device 5 for the drive 2. Reference is made to the statements above.

According to another independent teaching, a process for installation of the drive 2 in the motor vehicle door lock is important. That is, in a single installation motion with a single installation direction, both the drive 2 is inserted into the receiver 6 and also then the locking mechanism 9 is actuated. A robot gripper would be possible here which in a single linear movement first inserts the drive 2 into the receiver 6 and then by continuing the same movement actuates the locking mechanism 9.

The described automated installation of the drive 2 can be done promptly and technically very easily.

Finally, it is pointed out that all the aforementioned statements regarding the receiver 6 and the locking mechanism 9 can be applied accordingly to the receiver 21 and the locking mechanism 25.

The invention claimed is:

1. Motor vehicle door lock, comprising:

a drive with a drive motor, and a housing with a mounting device for the drive, the mounting device having a receiver for the drive;

wherein the receiver is at least partially flexible and has a flexibly movable part which is shiftable between a locking position which fixes the drive motor in the receiver and a position which enables the drive to be inserted in and removed from the receiver, wherein the mounting device has an actuatable locking mechanism, the locking mechanism being engageable with the receiver in a manner which moves the movable part into the locking position; and wherein the drive motor is insertable into the receiver by an installation motion in an installation direction, and wherein the actuating direction of the locking mechanism corresponds essentially to the installation direction.

2. Motor vehicle door lock as claimed in claim 1, wherein the locking mechanism positively engages the movable part of the receiver and keeps it in the locking position.

3. Motor vehicle door lock as claimed in claim 1, wherein the locking mechanism engages the movable part of the receiver and moves it into the locking position.

4. Motor vehicle door lock as claimed in claim 1, wherein the receiver has a receiver surface which engages the drive when the movable part is in the locking position, and wherein a holding force for fixing the drive acts on the drive via the receiver surface.

5. Motor vehicle door lock as claimed in claim 4, wherein at least a segment of the receiver surface is essentially cylindrical.

6. Motor vehicle door lock as claimed in claim 4, wherein the receiver is bridge-shaped, being formed of a pair of uprights that are connected by a crosspiece, and wherein the receiver surface is formed from a wall surface of the bridge-shaped receiver by a recess.

7. Motor vehicle door lock as claimed in claim 6, wherein the recess is an inlet slot that is open towards one edge of the bridge-shaped receiver and wherein the drive is insertable into the receiver via the inlet slot.

8. Motor vehicle door lock as claimed in claim 7, wherein the bridge-shaped receiver has at least one slit for increasing the flexibility of the receiver.

9. Motor vehicle door lock as claimed in claim 1, wherein the movable part of the receiver is a separate part from the remainder of the receiver.

10. Motor vehicle door lock as claimed in claim 1, wherein the locking mechanism has a slide which is movable in a guide, the locking mechanism being actuated by the displacement of the slide in an actuation direction.

11. Motor vehicle door lock as claimed in claim 10, wherein the slide is oblong viewed in the actuation direction, wherein the slide is T-shaped in cross section on a lengthwise side and wherein the guide in which the slide is movable has a corresponding T-shaped cross section.

12. Motor vehicle door lock as claimed in claim 10, wherein a lengthwise side of the slide has an actuating surface and wherein the actuating surface is engageable with the receiver for moving it into a state in which the drive is fixed therein.

13. Motor vehicle door lock as claimed in claim 10, wherein the slide viewed in the actuation direction is wedge-shaped and is adapted to deform the receiver.

14. Motor vehicle door lock as claimed in claim 10, wherein a lengthwise side of the slide has a shape and the receiver has a corresponding counter-shape and wherein the shape and the counter-shape are engageable with one another so as to hold the slide in an actuated position.

15. Motor vehicle door lock as claimed in claim 10, wherein the slide has engagement elements which mesh with counter-engagement elements on one of the receiver and the guide for holding the slide in an actuated position.

16. Motor vehicle door lock as claimed in claim 10, wherein the slide has squeezing ribs, wherein the squeezing ribs engage one of the receiver and the guide in a manner clamping the slide in the locking position.

17. Motor vehicle door lock as claimed in claim 10, wherein the locking mechanism has at least two slides which are movable in a respective guide, and wherein the slides engage the receiver at different points when moved in the actuating direction.

18. Motor vehicle door lock as claimed in claim 10, wherein the locking mechanism is initially fixed via a predetermined breaking point which is broken by initial actuation of the locking mechanism.

19. Motor vehicle door lock as claimed in claim 1, wherein the locking mechanism has a pivot flap, and wherein the locking mechanism is actuated by pivoting of the flap in the actuating direction.

20. Motor vehicle door lock as claimed in claim 1, wherein the locking mechanism is initially fixed via a predetermined breaking point which is broken by initial actuation of the locking mechanism.

21. Motor vehicle door lock as claimed in claim 1, wherein the mounting device comprises several parts and has at least two receivers with the corresponding locking mechanisms.

22. Motor vehicle door lock as claimed in claim 1, wherein the mounting device is at least partially an integral component of the housing.

23. Motor vehicle door lock as claimed in claim 1, wherein the receiver has a pair of uprights for receiving the drive between them, one of uprights being rigid and the other of the uprights being flexible, and wherein the locking mechanism deforms the flexible upright toward the rigid upright by engaging the receiver.

* * * * *